United States Patent [19]

Hamilton et al.

[11] Patent Number: 4,493,958

[45] Date of Patent: Jan. 15, 1985

[54] ILLUMINATED MEMBRANE SWITCH

[75] Inventors: Lawrence E. Hamilton, Chicago; Renzo N. Rutili, Evanston, both of Ill.

[73] Assignee: Stewart-Warner Corporation, Chicago, Ill.

[21] Appl. No.: 536,637

[22] Filed: Sep. 28, 1982

[51] Int. Cl.[3] ..... H01H 9/18

[52] U.S. Cl. ..... 200/314; 200/5 A

[58] Field of Search ..... 200/310, 313, 314, 317; 362/23, 26, 31

[56] References Cited

U.S. PATENT DOCUMENTS

| | | | |
|---|---|---|---|
| 4,163,883 | 8/1979 | Boulanger | 200/314 |
| 4,177,501 | 12/1979 | Karlin | 200/314 |
| 4,262,182 | 4/1981 | Basler et al. | 200/314 |
| 4,288,672 | 9/1981 | Puccini | 200/314 |
| 4,343,975 | 8/1982 | Sado | 200/314 |
| 4,349,705 | 9/1982 | Kuhfus | 200/314 |

FOREIGN PATENT DOCUMENTS

| | | | |
|---|---|---|---|
| 2928146 | 1/1981 | Fed. Rep. of Germany | 200/314 |

*Primary Examiner*—John W. Shepperd

*Attorney, Agent, or Firm*—Augustus G. Douvas

[57] ABSTRACT

An illuminated membrane switch assembly lighted by a contained rearwardly positioned bulb unit. A membrane switch is actuated by a small reciprocable transparent plunger with an illuminated graphics bearing overlay on its forward surface. Light is transmitted axially from the rear of the switch around the periphery of conductive areas on the membranes to the transparent plunger without any shadowing.

9 Claims, 13 Drawing Figures

10
11
12

20
17
35
29
36
37
38
41
33
30
39
31
32
40
43
46
47
48
49
18
16

22
20
35
17
43
16
23
25
24
56
14
26
11
12

Fig. 9.
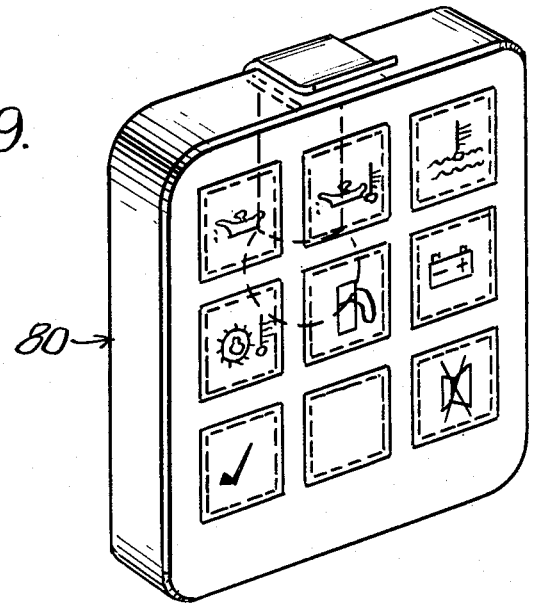
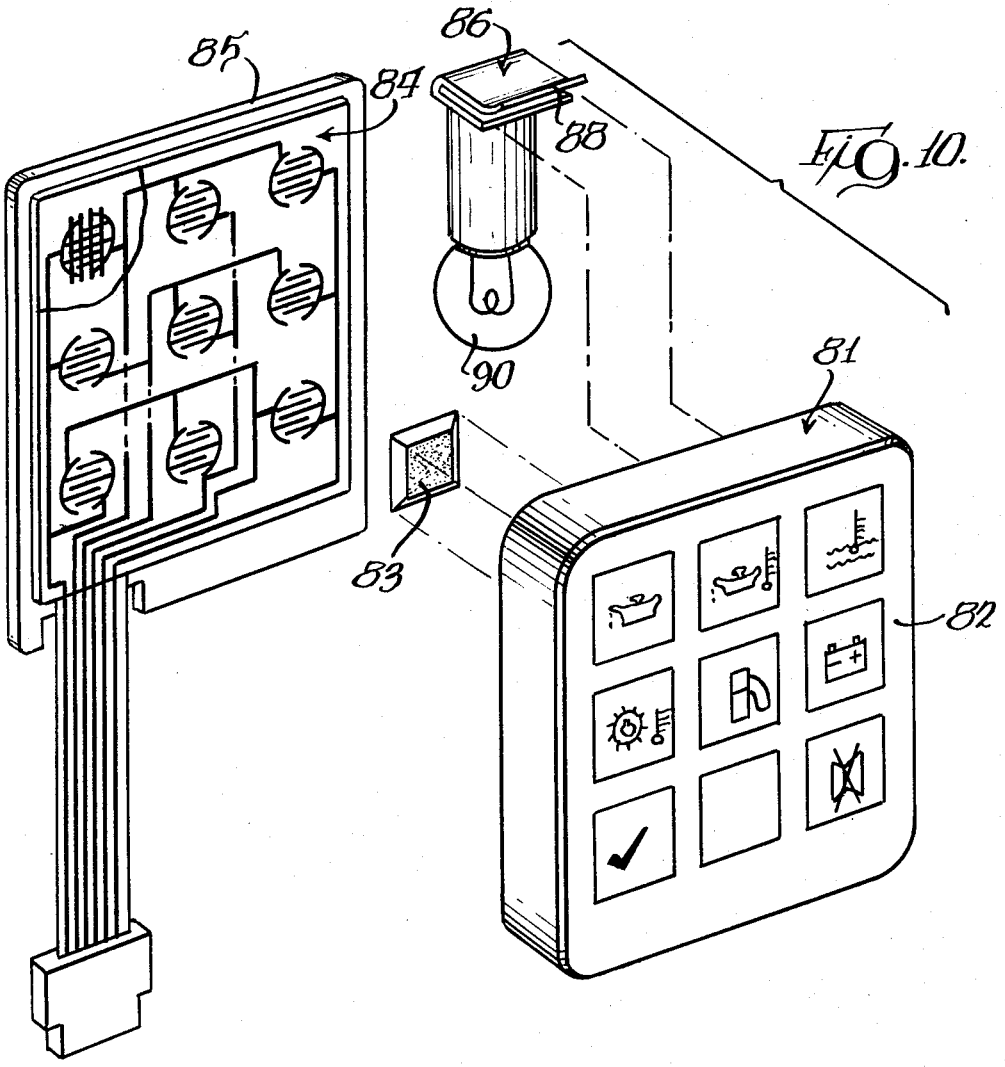
Fig. 10.

ILLUMINATED MEMBRANE SWITCH

BACKGROUND OF THE PRESENT INVENTION

Membrane switches, sometimes referred to as "touch contact switches", have achieved phenomenal success over the last decade due to their simplicity, reliability and very low cost. Generally these switches include upper and lower flexible plastic films separated by an intermediate spacer film. The outwardly directed surface of the upper film bears a matrix of separate switches e.g. an alpha-X numeric matrix or a functional symbol matrix. The lower side of the upper film has a plurality of conductive areas, one for each switch aligned with one of the indicia on the matrix and also aligned with cooperating conductive areas on the lower film. There have in the past been attempts to back light (light from a source positioned behind the switch) membrane switches but they have required specially designed conductive areas on the films to match the indicia on the individual switches to avoid shadowing and hence the conductive areas must be specially designed and tooled for each application.

In these specially designed switches the conductive areas (which are opaque) are configured so they are axially aligned with the opaque or non-illuminated portions of the indicia or graphics displayed to the operator that do not need to be illuminated. Since each indicia is different there must be specially designed conductive areas on the switch beneath all of them and since these switches are conventionally formed in matrix fashion each conductive area in the matrix would have a different configuration. This is an extremely costly switch assembly and even then such special fabrication results in some shadow lines across the illuminated indicia which are of course undesirable. Commonly the conductive areas include a plurality of parallel straight strips of silk screened, printed or electro deposited conductive elements, usually silk screened or printed and sometimes electro-deposited, although other techniques are employed to deposit these conductors on the facing surfaces of the upper and lower membrane films.

Either the upper or lower membrane film conventionally includes at each grid position a plurality of common finger-like conductors supplied by a common voltage source and a second plurality of conductive fingers connected to an output terminal interwoven with the first conductive strips but spaced therefrom so that upon depression of the switch the conductive area on the other membrane engages both sets of conductive strips on the lower membrane causing switch actuation. The conductive areas on the facing surface of the other membrane are parallel stripes, deposited by a similar technique, and they are sometimes referred to as "short bars". Usually these conductive areas on the upper membrane and the lower membrane have a generally circular configuration. This type of membrane switch is by itself conventional and of the type manufactured by Sierra Corporation of Sylmar Calif., Transparent Devices, Inc. of Westlake, Calif. and W. H. Brady Co., of Milwaukee, Wis.

Membrane switches of this general type have achieved a considerable degree of success in office and business equipment such as calculators, copying machines and cash registers and in a variety of other applications in which there is a readily available source of artificial ambient light. However, the membrane switch technology has not achieved any significant degree of success in applications where a constant source of ambient light is not always available such as in outdoor and vehicular applications because it has not been possible thus far adequately to illuminate the switch indicia. There have been attempts in the past to provide external forward lighting for membrane switches but they have not been successful, particularly in vehicular applications because of the natural reflectivity of the indicia surface displayed to the operator and also because external lighting requires positioning a light source outside the switch assembly and this demands either specially designed recessed instruments or special overhead lighting in the vehicle.

It has thus far not been possible to back light, i.e. light from the rear of the switch membrane or contact switches because the conductive areas described above on the membranes block significant portions of light passing forwardly through the switch.

It is the primary object of the present invention to provide an improved illuminated membrane switch.

SUMMARY OF THE PRESENT INVENTION

In accordance with the present invention an illuminated membrane switch assembly is provided that is illuminated by a light source contained within the confines of the switch assembly itself. Toward this end the present membrane switch includes first and second membrane films separated by a spacer element with a plurality of aligned conductive areas on each of the films defining a matrix of individual switches. The membrane films are housed in a transparent plastic molding having a plurality of apertures in the forward face thereof, each aligned and adjacent one of the membrane switches. A flexible graphic overlay is attached to the forward face of this housing having graphic indicia that may be alpha, numeric or functional symbols on the visible face thereof each over one of the apertures. Each of the apertures has a transparent plastic plunger reciprocal therein attached to the graphic overlay and movable a short distance upon finger contact with the selected graphic indicia to depress the short bars of the aligned switch against the conductive area on the other film closing the switch and providing a switch output signal. Thus the advantage of using this lighting and switch activation technique is that any "off the shelf" or "standard" membrane switch can be used vs. spending money to tool a "custom" membrane switch. Also, if there is any kind of a graphic change to be made, all that is required is changing the graphic overlay and not the switch.

In a first embodiment the plunger is rectangular in configuration and is edge lighted by a bulb unit mounted in a recess in a transparent forward panel of the housing. Light from the bulb passes transversely through the forward panel and through the side walls of the plunger into the body of the plunger itself. The rear wall of plunger is serrated, frosted or molded in a rough condition so that it acts as a deflector or diffuser to direct light, passing transversely through the plunger, generally forwardly toward the portions of the indicia on the graphic overlay to be illuminated. In a modified form of this same embodiment, the lamp units are mounted in recesses in the side walls of the housing and the entire housing is transparent so that light is transmitted forwardly through the side walls of the housing and then reflected transversely through the front wall of the housing by a reflective surface at the junctures between the side walls and the front wall.

In a preferred second embodiment of the present invention the light source is positioned within the housing just to the rear of the membranes and light passes peripherally around the generally circular conductive areas on the membranes into the plunger. The plunger has a somewhat different shape and is formed as a frusto-pyramid with its larger surface facing the membranes and its smaller forward surface attached to the rear surface of the graphic overlay. The rear surface of the plunger is significantly larger than the conductive areas on the membrane so that light may pass around the periphery of the conductive areas through the transparent membranes and into the plunger. The frusto-pyramidal shape of the plungers provides angular side surfaces that reflect the axially directed light transversely through the plunger. The rear surface of each plunger is opaque, light in color, and reflective to assist in directing light diffused within the plunger in a generally forward direction toward the indicia to be illuminated. This opaque reflective area is smaller than the rear surface of the plunger so that it does not inhibit the transmission of axially directed light around the conductive areas into the plunger interior.

BRIEF DESCRIPTION OF THE DRAWINGS

FIG. 9 is a perspective view of an illuminated membrane switch assembly according to another embodiment of the present invention;

FIG. 10 is an exploded perspective view of the illuminated membrane switch assembly according to FIG. 9;

DETAILED DESCRIPTION OF THE PREFERRED EMBODIMENTS

Figures 1, 2, 3:
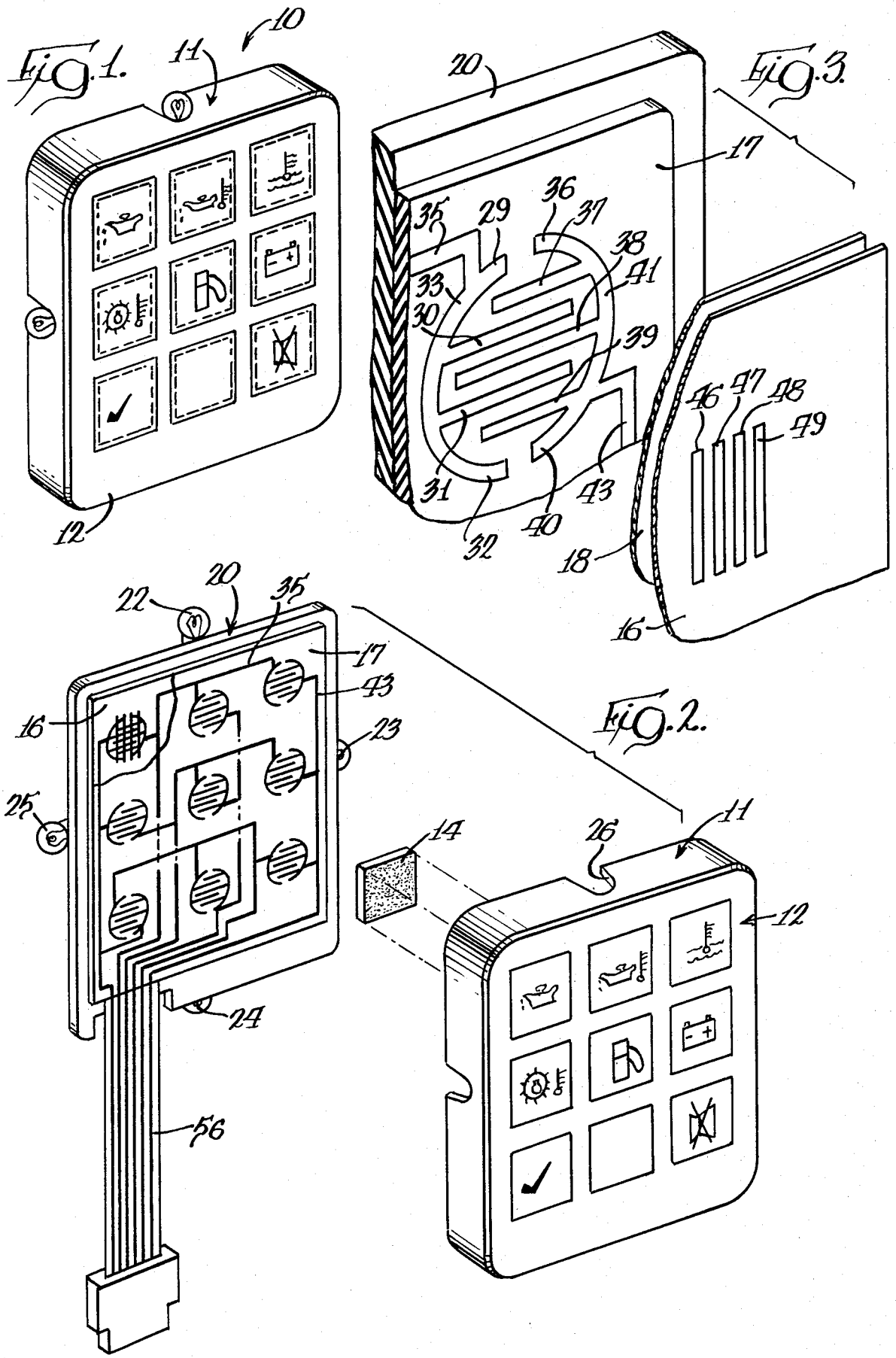
FIG. 1 is a perspective view of an illuminated membrane switch assembly according to one embodiment of the present invention.
FIG. 2 is an exploded perspective view of the illuminated membrane switch assembly illustrated in FIG. 1.
FIG. 3 is a fragmentary exploded perspective view of the conductive areas on an exemplary one of the switches illustrated in the illuminated switch of FIGS. 1 and 2.

Viewing the drawings and particularly FIGS. 1 to 3, an illuminated membrane switch matrix assembly 10 is illustrated generally including a cup-shaped transparent housing 11 with an indicia bearing graphics overlay 12 attached to its outer surface, a plurality of transparent plungers 14 mounted in recesses in the housing 11, a forward flexible membrane film 16 and a rear flexible membrane film 17, normally separated by a spacer film 18, and a rigid backing plate 20 that supports light bulb units 22, 23, 24 and 25 with their bulb axes centered in recesses 26 in the side walls of the cup-shaped housing 11.

As seen in the exploded fragmentary view of FIG. 3, each switch in the membrane switch sub-assembly includes portions of the forward membrane film 16, the spacer membrane film 18 and the rear membrane film 17. Conductors are deposited on the rear surface of the forward film 16 and forward surface of the rear film 17. The conductors may be formed by a plurality of metallic deposition techniques such as electro-chemical deposition or sputtering. The conductors on the forward surface of the rear film 17 include parallel conductor fingers 29, 30, 31 and 32 connected together by a common semi-circular conductor 33, all positively biased by an input conductor 35 fed from a positive d.c. source. The inner surface of film 17 has a second set of conductor fingers 36, 37, 38, 39 and 40 interconnected by a common semi-circular conductor 41 having an output conductor 43. Conductors 29, 30, 31 and 32 are interleaved with but spaced from conductors 36, 37, 38, 39 and 40.

The rear surface of the forward film 16 has a plurality, in this case five, of parallel conductor bars 46, 47, 48 and 49 thereon each having a length approximately equal to the diameter of the conductive area defined by the arcuate conductors 33 and 41 on film 17 and having a cummulative width slightly less than that diameter. The conductor bars 46, 47, 48 and 49 are sometimes referred to as "short bars" since when the switch is depressed engaging bars 46, 47, 48 and 49 with the conductive area on film 17 the conductors 29, 30, 31 and 32 are shorted to the conductors 36, 37, 38, 39 and 40 making the switch and causing an output at conductor 43.

Figure 5:
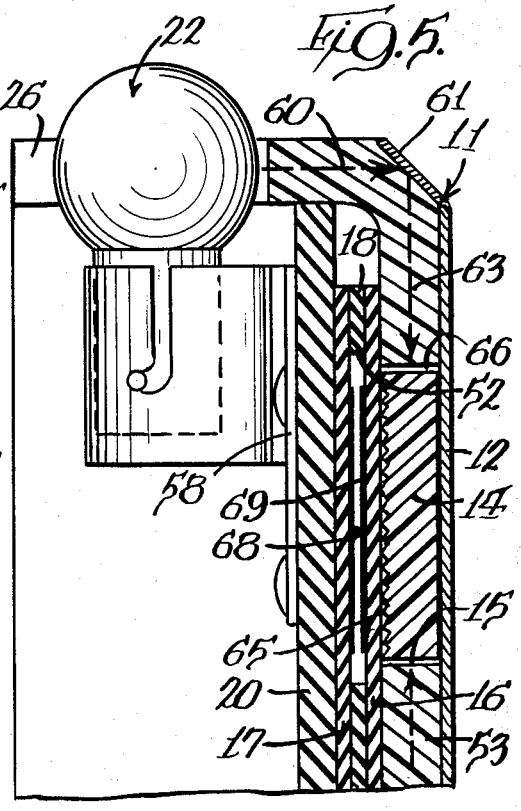
FIG. 5 is a fragmentary section taken generally along line 5—5 of FIG. 4 illustrating one of the switches and one of the bulb units.

The spacer 18 has an aperture 52 therein for each switch as seen in FIG. 5, usually circular, somewhat greater in diameter than the conductive areas on the films 16 and 17 so that it normally spaces film 16 from film 17 but permits engagement therebetween upon relatively small movement of the forward film 16 under finger pressure applied to graphic overlay 12.

As seen in FIG. 2, there is an input conductor 35 and an output conductor 43 provided for each of the nine switches shown in the matrix. As seen in this view there are three input conductors, each for one of the three horizontal lines of conductive switches, and three output conductors each for one of the three vertical rows of switches, making a total of six conductors that extend through a flexible terminal strip 56.

Figure 4:
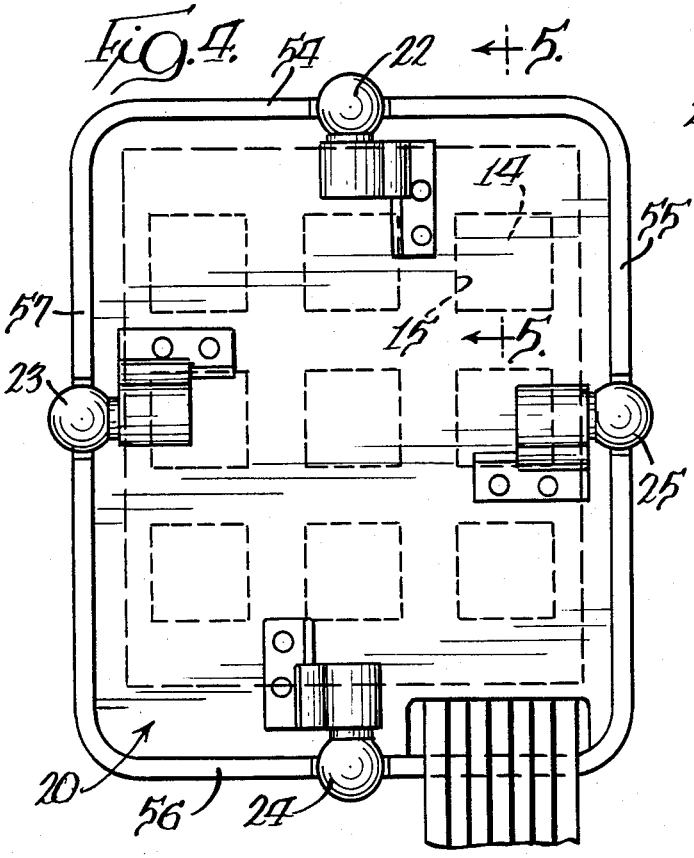
FIG. 4 is a rear view of the illuminated membrane switch assembly illustrated in FIG. 1.

Housing 11 is constructed of a rigid clear plastic such as an acrylic or polycarbonate. As seen in FIGS. 4 and 5, the housing 11 includes a forward flat plate portion 53 with depending side walls 54, 55, 56 and 57. The forward plate portion 53 has a plurality of rectangular apertures 15 aligned with the switches on the membrane films that slidably receive the plungers 14 for short reciprocating movement. The apertures 15 and the plungers 14 are arranged in grid fashion aligned with the nine switches but there may be any number of switches depending upon the application desired.

The flexible graphic overlay 12 may be a flexible vinyl or polycarbonate sheet that is opaque except for the functional symbols shown in FIG. 2 and their rectangular borders and these are translucent areas which pass light so that the functional indicia and the borders are illuminated. Sheet or overlay 12 is bonded pressure sensitive adhesive on the rear surface of the film to the forward face of the housing front plate 53 using a pressure sensitive adhesive on the rear surface of the overlay.

The backing plate 20 is a rigid flat plastic plate fixed within the housing by fasteners (not shown in the drawings) and it serves to hold membrane films 16, 17 and 18 in position within housing 11 with the forward surface of membrane 16 against the rear surface of the forward housing plate 53 as shown clearly in FIG. 5. Backing plate 20 also supports the bulb units 22, 23, 24 and 25 by brackets 58 fixed to the rear surface of the backing plate 20. The bulb units 22, 23, 24 and 25 are positioned on the backing plate 20 so that the optical axes of the bulbs are aligned with the center of the side walls 54, 55, 56 and 57 in recesses 26.

The housing 11 acts as an optical conductor to transmit light from the bulb units to the interior of the plungers 14. As seen in FIG. 5, light is transmitted forwardly in the direction of arrow 60 in the side walls and is reflected transversely by an opaque oblique corner surface 61 at each of the junctures between the side walls 54, 55, 56 and 57 and the front plate 53. The oblique surfaces 61 may be coated for example with a white paint or other reflective coatings. Light reflected transversely by the surfaces 61, as well as light bent through the housing corner itself without impinging on the reflective surfaces 61, is transmitted transversely in the direction of arrow 63 throughout the forward face of the front plate 53 into and around all of the plungers 14.

The plungers 14 are constructed of a rigid, clear plastic such as an arcylic or polycarbonate and they are bonded to the rear surface of the graphic sheet 12 by a suitable adhesive. Plungers or pistons 14 are preferably rectangular or circular in configuration but can be any geometric shape and are complementary to the housing apertures 45 and each has a rear surface 65 that is frosted, roughed or serrated or painted white to diffuse light passing transversely through the body of the plunger generally in a forward axial direction to improve the indicia illumination. The pistons 14 as shown are rectangular and have light transmissive side walls 66 that do not inhibit light passing into the plunger body.

For the purpose of defining the conductive areas on films the conductive areas shown in FIG. 3 on the forward face of rear film 17 are designated area 68 while the conductive areas defined by the short bars on the 46, 47, 48 and 49 on the rear surface of the forward film 16 are designated area 69 and both are seen to be slightly less in the width than the plunger 14.

Figure 6:
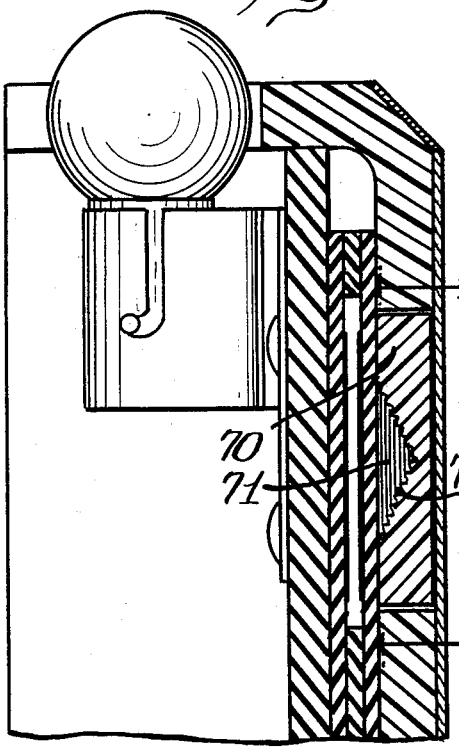
FIG. 6 is a fragmentary section generally similar to FIG. 5 with a modified switch plunger.

As seen in FIG. 6, the intensity of light across the plunger may be varied by modifying the rear surface of the plunger. The switch and its plunger illustrated in FIG. 6 are identical to that illustrated in FIG. 5 except for the rear surface of plunger 70. Plunger 70 as seen in both FIGS. 6 and 7 has a plurality of circular serrations 71 arranged in a cup-shaped semi-spherical recess 72 in the rear surface of the plunger 70. Serrations 71 concentrate the diffusion of light toward the center forward surface of the plunger 70. This becomes necessary because the middle button (plunger) gets robbed of some of the light by the buttons on either side of it. Other configurations of the rear surface of the plungers will concentrate light on other portions of the forward surface of the plungers and will be dictated by the type of indicia on the graphic sheet 12.

Figure 7:
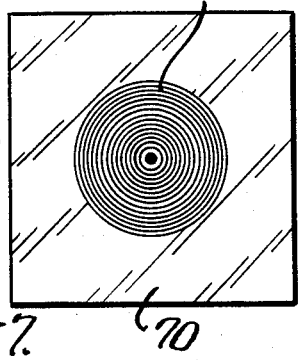
FIG. 7 is a rear sub-assembly view of the switch plunger illustrated in FIG. 6 taken generally along line 7—7 of FIG. 6.
Figure 8:
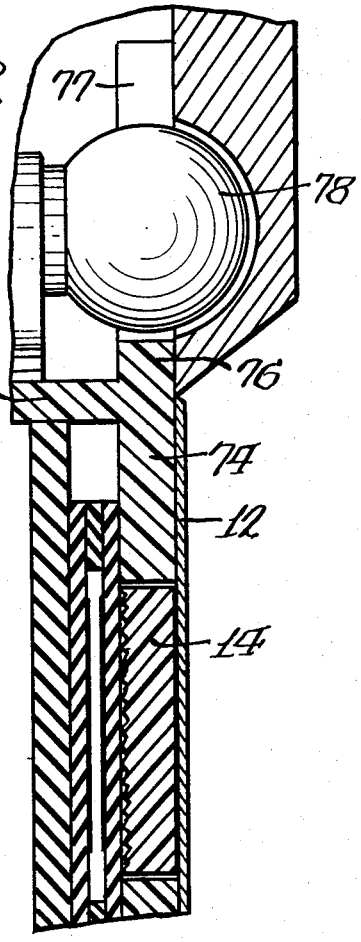
FIG. 8 is a fragmentary section generally similar to FIG. 5 of a modified form of the invention illustrated in FIGS. 4 and 5 with the bulb unit positioned in line with the switch housing front panel.

A somewhat modified form of the invention shown in FIGS. 1 to 5 is illustrated in FIG. 7. In this embodiment the housing has a front plate 74 and depending sides 75, and the front plate 74 has an integral coplanar portion 76 that extends outwardly from the side walls with a plurality of recesses 77 therein which receive the bulb units 78 mounted on the outside of the side walls 75, with the optical axes of the bulbs on the centerline of the front plate 74. In this embodiment light is transmitted in a straight line through front wall 74 into the side walls of the plungers 14.

Another embodiment of the invention is illustrated in FIGS. 9 to 13 and is generally similar to the embodiments (prime invention) illustrated in FIGS. 1 to 8 except that the switches are illuminated from the rear through the membrane films.

As seen in FIGS. 9 to 12, an illuminated membrane switch assembly 80 is illustrated consisting of a cup-shaped housing 81 identical to housing 11 described in connection with the FIGS. 1 to 8 embodiments, a graphic indicia bearing overlay 82 carried on the forward surface of the housing 81 identical to the film 12 described above, a plurality of light transmissive plungers 83 reciprocable in apertures in the housing 81, a membrane switch sub-assembly 84, a rigid wear backing plate 85, and a bulb assembly 86 mounted behind the membrane switch 84. The plungers 83 are bonded to the rear surface of the graphic overlay or film sheet 82 as in the FIGS. 1 to 8 embodiments.

Figure 11:
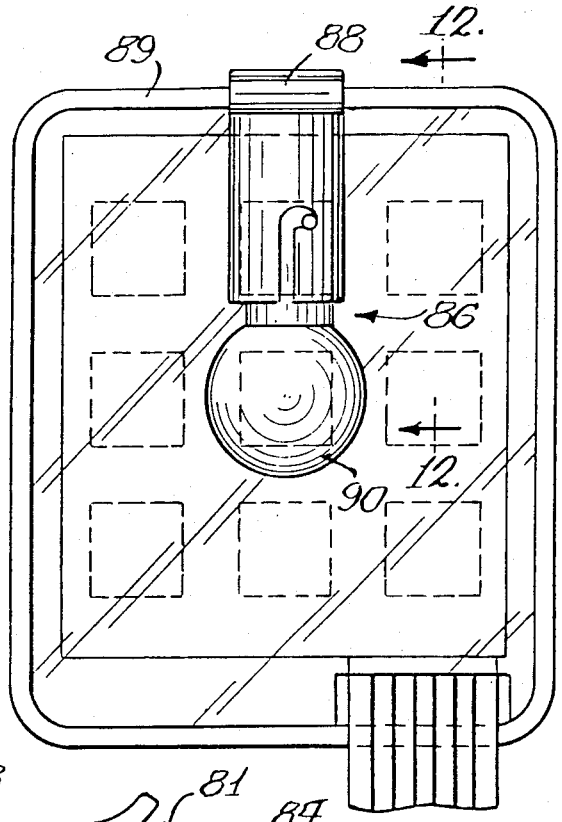
FIG. 11 is a rear view of the illuminated membrane switch assembly illustrated in FIG. 9.

As seen in FIG. 11, the bulb assembly 86 has a clip 88 press-in socket in metal case that clamps on housing side wall 89 positioning its bulb 90 centrally in the rear of the housing 81 just to the rear of the backing plate 85. The bulb 90 and clip 88 assembly will actually be further behind the rigid backing plate 85 than is shown in FIG. 12 so that the proper amount of light can be evenly dispersed to all plungers 83.

The membrane switch sub-assembly 84 is identical to that described above with respect to FIGS. 2, 3 and 5 and includes a forward film 92, a rear film 93 and a spacer film 94 all of which are transparent except for the conductive areas.

The rear surface of the forward film 92 has a conductive area 96 identical to conductive area 69 in FIG. 5 and the forward surface of film 94 has a conductive area 97 identical in size and configuration to conductive area 68 in the FIG. 5 embodiment.

Figure 12:
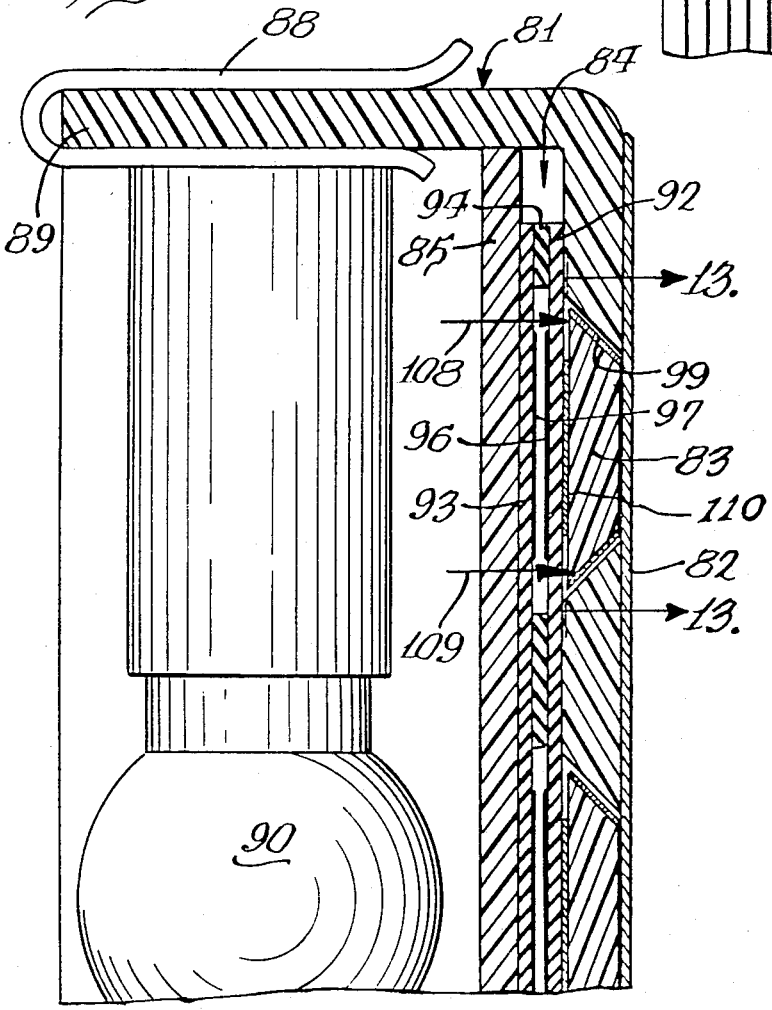
FIG. 12 is a fragmentary section taken generally along line 12—12 of FIG. 12 illustrating one of the switches in the matrix.
Figure 13:
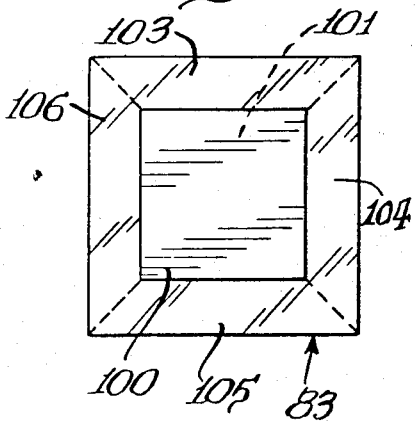
FIG. 13 is a rear sub-assembly view of the switch plunger illustrated in FIG. 12 taken generally along line 13—13 in FIG. 12.

The plungers 83 are constructed of a rigid clear light transmissive plastic such as a transparent acrylic or polycarbonate and as seen in FIGS. 12 and 13 are frusto-pyramidal in configuration and received in complementary recesses 99 in the housing 81. Plungers 83 have a square rear surface 100 and a smaller front surface 101 interconnected by oblique side walls 103, 104, 105 and 106 that each have an included angle of approximately 45 degrees with the rear wall 100. It should be understood that the backing plate 85 is constructed of a clear plastic material so that light from the bulb 90 may pass freely therethrough and through the films 92, 93 and 94, except of course in the area of the conductive areas 96 and 97.

The rear surfaces 100 of the plungers 83 are significantly wider than the conductive areas 96 and 97 so that light may pass peripherally directly around the conductive areas 96 and 97 from the light source in the direction of arrows 108 and 109 illustrated in FIG. 12 directly into the rear surface of the plunger and the body of the plungers. After axially entering the plungers, light is reflected or diffused transversely within the plunger by the oblique side walls 103, 104, 105 and 106 which may have a reflective coating applied thereto.

The rear surfaces 100 of the plungers have a square opaque, preferably white in color, reflective layer 110 applied thereto which masks any shadowing that might be caused by light rays passing partly through the conductive areas 96 and 97, and also serves to diffuse light passing generally transversely through the body of the plunger forwardly toward the indicia to be illuminated on the graphic overlay 82.

I claim:

1. An illuminated membrane switch assembly, comprising; a first transparent flexible film member having a conductive area on one side thereof, a second transparent flexible film member adjacent and normally spaced from the one side of the first film member, said second film member having a conductive area on the side thereof adjacent the first film member and including spaced switch contacts positioned to be electrically closed when simultaneously contacted by the conductive area on the first film member when one of the film members is pressed into engagement with the other film member, a movable switch actuator member mounted adjacent one of the first and second film members having a width greater than the conductive areas and having indicia thereon on the side thereof opposite the first and second film members, a source of light, transmission means for transmitting light from the source through the first and second film members into the side of the actuator member toward the first and second film members, and means for preventing light from passing through the conductive areas into the actuator member.

2. An illuminated membrane switch assembly, as defined in claim 1, including a stationary housing having an opening therein adjacent the conductive areas, said actuator member including a transparent plunger slidable in said opening, said indicia being defined by a flexible graphics overlay attached over the housing opening and connected to the transparent plunger, said transmission means transmitting light into the transparent plunger to illuminate the indicia.

3. An illuminated membrane switch assembly, as defined in claim 2, wherein said light source is positioned on the side of the first and second film members opposite the transparent plunger, said light transmission means including a transparent plate supporting and parallel to the first and second film members on the side thereof opposite the transparent plunger for directing light from the source generally axially around the conductive areas on the first and second film members into the transparent plunger to illuminate the indicia.

4. An illuminated membrane switch assembly, comprising; a first transparent flexible film member having a conductive area on one side thereof, a second transparent flexible film member adjacent and normally spaced from the one side of the first film member, said second film member having a conductive area on the side thereof adjacent the first film member and including spaced switch contacts positioned to be electrically closed when simultaneously contacted by the conductive area on the first film member when one of the film members is pressed into engagement with the other film member, a light transmissive switch actuator member having a width greater than the conductive areas and having indicia thereon adapted to be illuminated mounted for movement on one side of and in alignment with the conductive areas on the first and second film members, a source of light mounted on the side of the first and second film members opposite the switch actuator member, light transmissive means for directing light from the source through the first and second film members into the rear of the light transmissive switch actuator member to illuminate the indicia thereon, and means for preventing light from passing through the conductive areas into the actuator member.

5. An illuminated membrane switch assembly, as defined in claim 4, wherein the switch actuator member has at least one side wall angularly positioned at an angle other than 90 degrees to the indicia to assist in directing light from the source transversely across the actuator member.

6. An illuminated membrane switch assembly, comprising; a first flexible film member having a conductive area on one side theref, a second flexible film member adjacent and normally spaced from the one side of the first film member, said second film member having a conductive area on the side thereof adjacent the first film member and including spaced switch contacts positioned to be electrically closed when simultaneously contacted by the conductive area on the first film member when one of the film members is pressed into engagement with the other film member, a light transmissive switch actuator member having indicia thereon adapted to be illuminated mounted for movement on one side of and in alignment with the conductive areas on the first and second film members, a source of light mounted on the side of the first and second film members opposite the switch actuator member, light transmissive means for directing light from the source into the light transmissive switch actuator member to illuminate the indicia thereon, means for preventing light from passing through the conductive areas into the actuator member, the actuator member having a width greater than the width of the conductive areas so that light directed axially around the conductive areas will be received by the switch actuator member, and an opaque reflective surface on the rear surface of the actuator member to assist in directing light forwardly through the actuator member toward the indicia, said reflective surface having a width less than the width of the rear surface so that it does not interfere with light transmission through the rear surface from the source.

7. An illuminated membrane switch assembly, comprising; a first flexible film member having a conductive area on one side thereof, a second flexible film member adjacent and normally spaced from the one side of the first film member, said second film member having a conductive area on the side thereof adjacent the first film member and including spaced switch contacts positioned to be electrically closed when contacted by the conductive area on the first film member when one of the film members is pressed into engagement with the other film member, a light transmissive switch actuator member having indicia thereon adapted to be illuminated mounted for movement on one side of and in alignment with conductive areas of the first and second film members, a source of light mounted on the side of the first and second film members opposite the switch actuator member, light transmissive means for directing light from the source into the light transmissive switch actuator member to illuminate the indicia thereon, means for preventing light from passing through the conductive areas into the actuator member, and a housing for the first and second film members including a front plate having an aperture therein aligned with the conductive areas on the first and second film members, said switch indicia being defined by a flexible graphic overlay on the forward surface of the front plate extending over the aperture therein, said actuator member including a transparent plastic plunger reciprocable in the aperture and attached to the graphic overlay, said plunger having oblique reflective side walls to assist in directing light transversely through the plunger, said plunger having a rear wall having a width greater than the widths of the conductive areas so that it may receive light directed around the conductive areas, said plunger rear wall having a reflective surface for directing light in the plunger generally forwardly toward the graphic overlay, said reflective surface being centrally located on the plunger rear wall and having a width less than the width of the plunger rear wall to permit light directed by the transmissive means to pass through the periphery of the rear wall into the plunger.

8. An illuminated membrane switch assembly, comprising; a first transparent flexible film member having a conductive area on one side thereof, a second transparent flexible film member adjacent and normally spaced from the one side of the first film member, said second film member having a conductive area on the side thereof adjacent the first film member and including spaced switch contacts positioned to be electrically closed when simultaneously contacted by the conductive area on the first film member when one of the film members is pressed into engagement with the other film member, a light transmissive switch actuator member having a width greater than the conductive areas and having indicia thereon adapted to be illuminated mounted for movement on one side of and in alignment with the conductive areas on the first and second film members, said actuator member being a generally rectangular plunger with oblique side walls to assist in directing light across the plunger interior, said oblique side walls being located in axial alignment with portions of the transparent first and second film members immediately outside the conductive areas, a transparent backing plate for the first and second film members, and a source of light positioned behind the backing plate for directing light through the backing plate, through the first and second film members immediately around the conductive areas thereon and into the rear surface of the plunger adjacent the periphery of the plunger impinging on the oblique side walls.

9. An illuminated membrane switch assembly as defined in claim 8, including a light reflective surface on the rear surface of the plunger having a width less than the plunger rear surface.

* * * * *